US006893288B2

(12) United States Patent
Tsunematsu

(10) Patent No.: US 6,893,288 B2
(45) Date of Patent: May 17, 2005

(54) ELECTRICAL CONNECTOR FOR A FLAT CABLE

(75) Inventor: Kazuhisa Tsunematsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 4 days.

(21) Appl. No.: 10/701,601

(22) Filed: Nov. 6, 2003

(65) Prior Publication Data

US 2004/0171293 A1 Sep. 2, 2004

Related U.S. Application Data

(62) Division of application No. 10/084,301, filed on Feb. 28, 2002, now Pat. No. 6,767,233.

(30) Foreign Application Priority Data

Mar. 23, 2001 (JP) ..... 2001-83959

(51) Int. Cl.[7] ..... H01R 12/24
(52) U.S. Cl. ..... 439/495; 439/260
(58) Field of Search ..... 439/260, 495

(56) References Cited

U.S. PATENT DOCUMENTS 6,099,346 A * 8/2000 Hashiguchi et al. ..... 439/495
6,171,137 B1 * 1/2001 Hatakeyama ..... 439/495
6,224,418 B1 * 5/2001 Miura et al. ..... 439/495
6,352,442 B1 * 3/2002 Kudo ..... 439/260
6,383,017 B1 5/2002 Takayasu
6,431,907 B1 * 8/2002 Ma ..... 439/495
6,471,541 B2 * 10/2002 Kunishi et al. ..... 439/495

FOREIGN PATENT DOCUMENTS

| | | |
|---|---|---|
| EP | 0026568 A | 4/1981 |
| EP | 0696090 A | 2/1996 |
| EP | 0773608 A | 5/1997 |
| EP | 0895320 A | 2/1999 |
| EP | 0926778 A | 6/1999 |
| EP | 1043806 A | 10/2000 |

* cited by examiner

*Primary Examiner*—Gary Paumen
(74) *Attorney, Agent, or Firm*—Takeuchi & Takeuchi

(57) ABSTRACT

An electrical connector for a flat cable (C) comprises a housing (1) having an open mouth (14), a plurality of terminals (2) arranged and maintained in the housing, each terminal having a contact section (12) at a position facing the open mouth of the housing and a bearing section (4) at a position corresponding to and opposed to the contact section with respect to the flat cable, and a pressure member (15) rotatable between an open position and a closed position. The pressure member includes a plurality of grooves for receiving ends of the terminals and at least one pressure section provided between the grooves for pressing the flat cable to the contact sections at the closed position.

5 Claims, 5 Drawing Sheets

ELECTRICAL CONNECTOR FOR A FLAT CABLE

CROSS REFERENCE TO RELATED APPLICATIONS

This is a division of application Ser. No. 10,084,301 filed Feb. 28, 2002, now U.S. Pat. No. 6,767,233.

BACKGROUND OF THE INVENTION

1. Field of the Invention

The present invention relates to electrical connectors for a flat cable.

2. Description of the Related Art

Japanese patent application Kokai No. 9-35828 discloses an electrical connector of this type.

As FIG. 5 shows, in this connector, a flat cable (flexible board) 51 is inserted into an inserting space of an open mouth in a surface direction of the flat cable, direction A in the figure, so as to be placed on contact sections 54 of terminals which are arranged facing to the open mouth of a housing 52. This inserting space is like a very narrow slit, and slightly larger than the cross-sectional shape of the flat cable 51. To ensure the inserting position of the flat cable 51, restricting blades 55 which contact with upper surface of the inserted flat cable at its lower surfaces are attached at both sides in the cross direction of a flat cable. The restricting blade 55 has a surface edge that is perpendicular to the inserting direction of the flat cable. At the open mouth of the housing 52, a pressure member 56 to open and close the open mouth is attached to the housing, so as to freely rotate. The pressure member 56 enables insertion of a flat cable 51 at open position by opening the inserting space, while it presses the inserted flat cable against the connection section 54 of a terminal.

However, in this type of connector, the entrance of inserting space is so deeply located that it is difficult to see, and is narrow, so that the flat cable 51 can not be inserted in there easily. Moreover, for a connector required to be low profile, it is impossible to design a large inserting.

In addition, in the connector, the position of pressure member 56 is unstable because it is not fixed at the open position, and sometimes it turns over to the closed position unintentionally at the time of inserting a flat cable. In this case, the pressuring member 56 makes it further difficult to see the entrance of the inserting space.

Also, if the front edge of a flat cable hits the surface edge 55A of restricting blade 55 which is supposed to define the inserting position of a flat cable 51, and then an inserting force is applied despite of that, the surface of the flat cable is bent backward so that the cable can not be inserted. The pressure member and restricting blade, like this, worsen above-mentioned problem.

SUMMARY OF THE INVENTION

In view of those problems, it is an object of this invention to provide an electrical connector for a flat cable that enables easier insertion of a flat cable.

An electrical connector for a flat cable according to the present invention has a plurality of terminals which are arranged and held in a housing and have contact sections at the position facing to an open mouth of the housing, and a pressure member which can freely turn around a rotational axis positioned in opposite side of flat cable to contact section, wherein the pressure member can freely turn over between an open position which opens inserting space to enable insertion of a flat cable into the open mouth and a closed position which pushes the flat cable towards contact section closing the inserting space.

According to one aspect of the invention, there is provided an electrical connector which comprises a terminal which has bearing section for rotational movement of a pressure member at the rotational axis; and engaging section to hold the pressure member at the open position by engaging force generated by concerted movement between the terminal or the housing and the pressure member when the pressure member turns over to the open position.

The pressure member of this connector with this structure is maintained at open position by its engaging force with terminal or housing, if the pressure member is turned over to open position at the time of inserting a flat cable. Accordingly, inserting space is certainly held open, so that flat cable can be easily inserted.

According to the present invention, an engaging section can be designed to be formed at a terminal or a housing and a pressure member by parallel or perpendicular surface to rotational axis. In any case, engagement is performed at supposed position by increase of surface pressure on the surface.

In a case that the engaging section is formed by parallel surface to the rotational axis, pressure member has a slot to which a part of a support arm of a terminal slides when the pressure member turns over to open position, and the support arm has a shoulder which engages with inner wall of the slot when the pressure member reaches the open position, so that it is as if this inner wall and the shoulder form engaging section which is parallel to rotational axis. The shoulder can be like a cam.

According to another aspect of the invention, a pressure member has a shaft along a rotational axis at both sides of arrangement direction of above-mentioned terminal, there is an engaging piece to turn around and support the shaft in proximity of both sides of connector, and the engaging piece and pressure member have engaging section to hold the pressure member at the open position by engaging force generated by concerted movement when the pressure member is turned over to the open position. Preferably, in this aspect, an engaging piece as a separate member is attached to a housing, and forms an engaging section with the pressure member. It is further preferable if the engaging piece as a separate member is metal piece in view of its strength. This metal piece is attached in the proximity of both sides of housing. In this case, engaging section is formed as a protrusion, such as cam, which is formed on upper edge of the metal piece, so that the shaft of the pressure member can be designed to engage by turning over the top of the protrusion.

According to still another aspect of the invention, a housing holds guides, which are positioned at both sides of the housing in the width direction of a flat cable. The lower edge of the guide is provided in a position so as to guide upper surface of a flat cable when it is inserted at regular position, and slanted inward in the width direction towards inserting direction of flat cable and inward towards housing.

In this aspect, since guides are attached to a housing, even if a front edge of a flat cable hits a surface of the guide at the time of inserting the flat cable, the flat cable is still inserted despite of its bend at the front corner edge because the guides are slanted inward. Therefore, after all the flat cable slides into a regular position, that is, inserting space, losing the bend by its elasticity.

The guide can be designed to be bent to form as a metal piece which is almost right angled to the surface of flat cable and attached to both sides of a housing. Here, upper edge of the guide can be slanted or curved toward tip in the direction of lower edge. The guide of this shape can be easily made as a metal piece. Moreover, even if a flat cable slides onto the upper edge of the guide when it is inserted, it is led downward because of the slant of the tip. In this case, it slides into inserting space offsetting its elasticity by pushing the bend section lightly by finger, and the bend is disappeared.

DESCRIPTION OF THE PREFERRED EMBODIMENTS

Embodiments of the invention will now be described with reference to the accompanying drawings.

First Embodiment

Figure 1A:
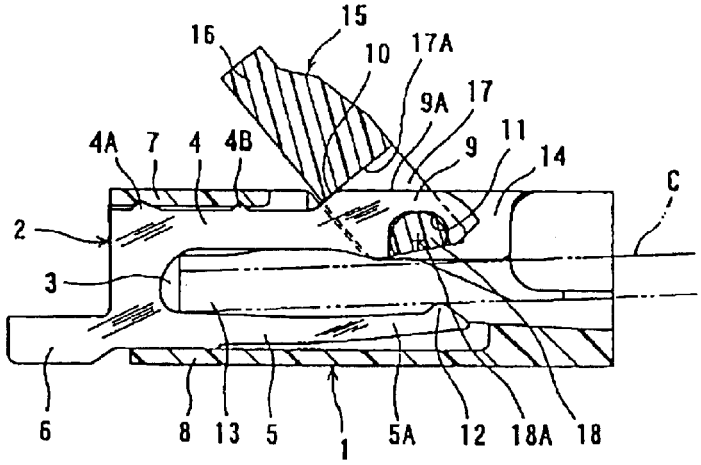
FIGS. 1(A) through (C) are sectional views of an electrical connector according to the first embodiment of present invention. The pressure member is at the open position in FIG. 1(A), at in-between position in FIG. 1(B), and at the closed position in FIG. 1(C).
Figure 1B:
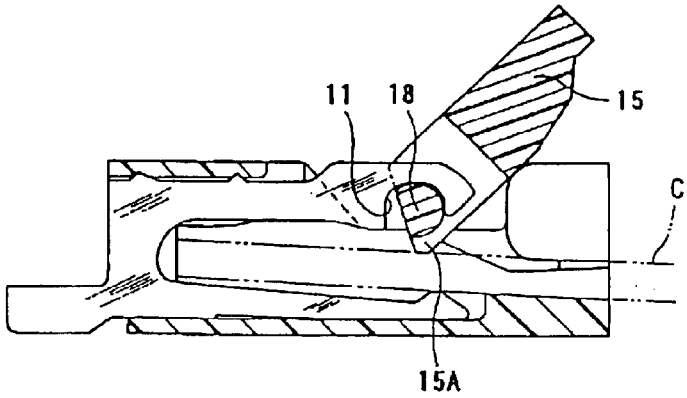
Figure 1C:
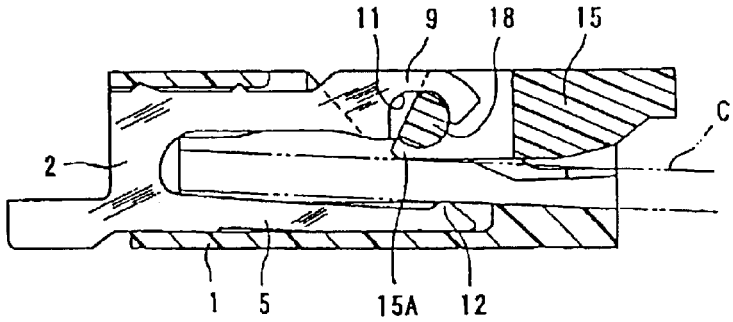

In FIGS. 1(A) through (C), an electrical connector for a flat cable according to the first embodiment of the invention has a housing which holds a plurality of terminals 2. The terminal 2 is made by stamping a metal sheet and the like, and maintains flat surface which is parallel to the sheet. The plurality of terminals 2 are arranged with certain intervals between each terminals. The terminal 2 is pressed from left side in the figures into corresponding slit-shaped receiving slot which is parallel to the sheet.

The terminal 2 has an upper arm (support arm) 4, a lower arm 5, and a connection section 6, wherein the upper arm 4 and lower arm 5 are located along the inner surfaces of upper wall 7 and lower wall 8 which forms slot 3 of the housing, and the connection section 6 protrudes to outside of the housing from the lower wall 8. The upper arm 4 has engaging protrusions 4A and 4B at upper edge of the base area, so as to prevent sliding out of the slot by engaging into inner surface of the upper wall 7 of the housing when the terminal 2 is inserted to a prescribed position from left side. The upper arm 4 has relatively high rigidity, relating to deflection within the sheet of the figure, especially higher rigidity in comparison with lower arm 5. An end section 9 of the upper arm 4 is made wider, and the upper edge 9A is positioned upward (outer) from lower surface (inner surface) of the upper wall 7 of the housing. Also, the transitional section from the upper edge 9A to the upper arm 4 forms a shoulder 10 with gentle slope.

A bearing section 11 which has a concave shape is provided at the lower portion of the end section 9. This bearing section 11 is to support a pressure member described below in a manner that the pressure member can freely turn around, and has a function of a bearing. Since the upper edge 9A is upward from the lower surface of upper wall 7 of the housing and extends to the proximity of upper surface of the upper wall, the distance between the bottom of the slot of the bearing section and upper edge 9A is kept so wide that the section around this area is strong.

The lower arm 5 of the terminal 2 has narrower width (in the height direction in the figure) in comparison with the upper arm 4, and has flexibility in a plane parallel to the sheet. Also, it has an incline 5A which inclines upward from the lower edge of the lower arm 5, especially at the section close to the end of the arm, and contact section 12 which protrudes toward the bearing section 11 of the upper arm 5.

As described above, the housing 1 has as many slit-shaped receiving slots 3 to insert the terminal 2 from left as the number of terminals in parallel to the sheet, wherein the terminals are made from a metal sheet and maintains the sheet surface. The inserting position of the terminal 2 is determined by the upper wall 7 and lower wall 8 of housing 1 which define the upper edge and lower edge of the receiving slot 3. The base section of the lower arm 5 contacts with the inner surface of the lower wall 8, and as described above, the position of a terminal is secured and the sliding out of the terminal is prevented by the engagement of engaging protrusions 4A and 4B of the upper arm 4 into the upper wall 7 of housing.

The housing 1 has a cable slot 13 to insert a flat cable C from right side into the housing 1. The cable slot 13 passes through a plurality of receiving slots provided between the sides walls, having a width substantially the same as the flat cable C (dimension in perpendicular to the sheet), that is, almost the same width as the arranging distance between the plurality of terminals, Also, an upper part of the cable slot 13 is open, so that housing has an open mouth 14. The open mouth 14 is, in lateral direction, open rightward and extends to end of upper wall 7 of housing 1 leftward, and in longitudinal direction, as described above, is open upward from the cable slot 13.

The open mouth 14 of the housing 1 has a pressure member 15 which is made of insulating material. The pressure member 15 can freely turn over between the open position in FIG. 1(A) and the close position in FIG. 1(C), and is supported by the bearing section 11 of terminal 2. The pressure member 15 has an operating section 16 at top side, and grooves 17 at the opposite side. The operating section 16 is to give turning force to the pressure member 15, and the groove 17 is to put the end 9 of the terminal 2 in. Accordingly, the groove 17 has a slit in a zigzag fashion corresponding to the terminal 2. And a shaft 18 is attached in the groove 17, and supported by the bearing section 11 of terminal 2 so that the shaft can freely rotate. For the groove 17, at the open position in FIG. 1(A), distance between the bottom 17A and center 18A of the shaft 18 (rotational axis) is slightly larger than the one between the center 18A of shaft 18 and the shoulder 10, and the bottom 17A of the groove 17 presses in and engages with shoulder 10 of the terminal 2, so as to strongly engage with each other. At the open position of the pressure member, this bottom 17A and the shoulder 10 work together as engaging sections, and holds the pressure member 15 at the open position by the engaging force.

As described above, the connector in present embodiment is used in the following manners:

1) First, arrange a connector to prescribed position on a circuit board (not illustrated), and connect the connection section 6 of a terminal 2 with a corresponding circuit section of the circuit board by soldering or so.

2) Then, turn a pressure member 15 over to the open position as in FIG. 1(A). At the open position, the pressure member 15 is maintained at the open position being restricted from the turning back to the closed position by the engaging force between bottom 17A of groove 17 of the pressure member 15 and shoulder 10 of the terminal 2 which form an engaging section together.

3) When the pressure member 15 is at the open position, the open mouth 14 is maintained widely open rightward. Accordingly, it is easy to see the entrance of a cable slot 13 (inserting space) from inserting direction of a flat cable C. The flat cable needs to be inserted into the cable slot 13 with its contact surface as lower surface until the front end of the cable contacts with deepest wall of the groove.

4) After inserting the cable to the prescribed position, release the engagement by turning the pressure member clockwise against engaging force, and then turn over to the closed position in FIG. 1(C) via an in-between position in FIG. 1(B). The pressure member 15 strongly pushes the flat cable C towards the contact section 12 with its pressure section 15A, and then both are electrically connected.

Second Embodiment

In the second embodiment, an engaging section is formed by a pressure member, and an engaging piece is formed separately from the terminal between the pressure member and the terminal to make the insertion of cable easier.

Figure 2A:
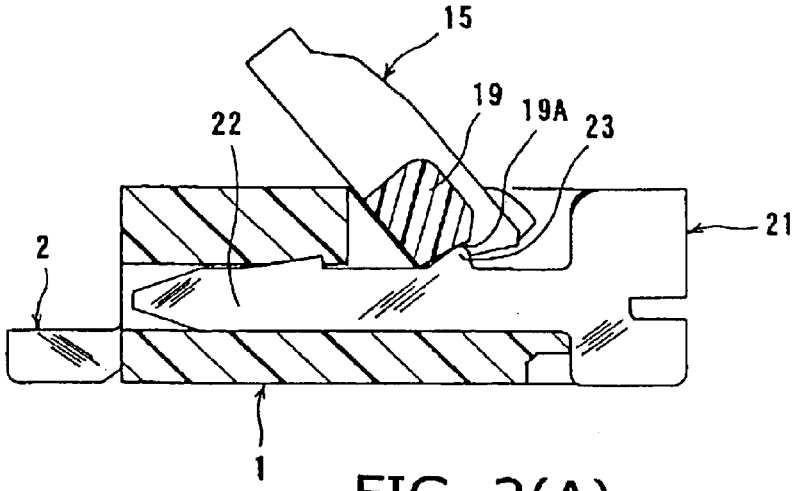
FIGS. 2(A) through (C) are sectional views of an electrical connector according to the second embodiment of the present invention. The pressure member is at the open position in FIG. 2(A), at in-between position in FIG. 2(B), and at the closed position in FIG. 2(C).

In FIG. 2(A), the engaging piece 21 is made by stamping a metal sheet, similar to the terminal 2, maintains its flat sheet surface, and is arranged in parallel to the terminal 2. The engaging pieces 21 are attached to proper position in arrangement direction of a plurality of terminals 2, for an example, at both sides of the terminal arrangement, in addition, and at proper position or positions between them.

Figure 2B:
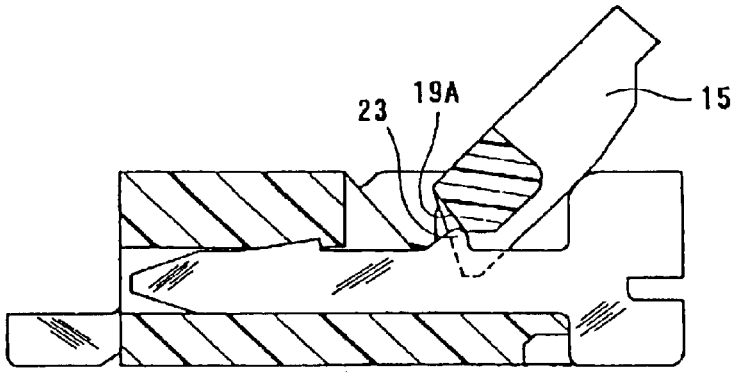
Figure 2C:
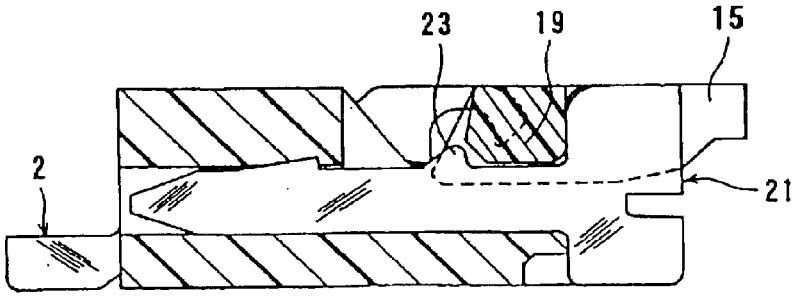

The engaging piece 21 has a protrusion, such as cam 23, at arm 22 which is pressed into the housing from right side, as an engaging portion at the position which corresponds to the shoulder 10 of the terminal 2 in FIG. 1. At the same time, the pressure member 15 has a cam follower 19 so as to move along the cam 23. The concerted movement of the cam follower 19 along the cam 23 generates a strong engaging force when the pressure member is at the open position as in FIG. 2(A), and releases the engaging force gradually weakening as it turns over to the closed position of FIG. 2(C) from the position of FIG. 2(B).

The engaging piece like this tends to be considered the same as the terminal with shoulder in FIG. 1 from its appearance. However, even if the principle of generating engaging force is the same, the terminal does not have to have a function of generating engaging force, so that there is a great feature that it can work without receiving undue stress. In other words, the stress does not affect how the terminal contacts.

Third Embodiment

The third embodiment has a feature of having a guide which guides a flat cable to a regular position and in a regular direction at the time of inserting a flat cable, not engaging the pressure member at the open position as in the first and the second embodiments. This guide can be formed together with the engaging piece in the second embodiment.

Figure 3:
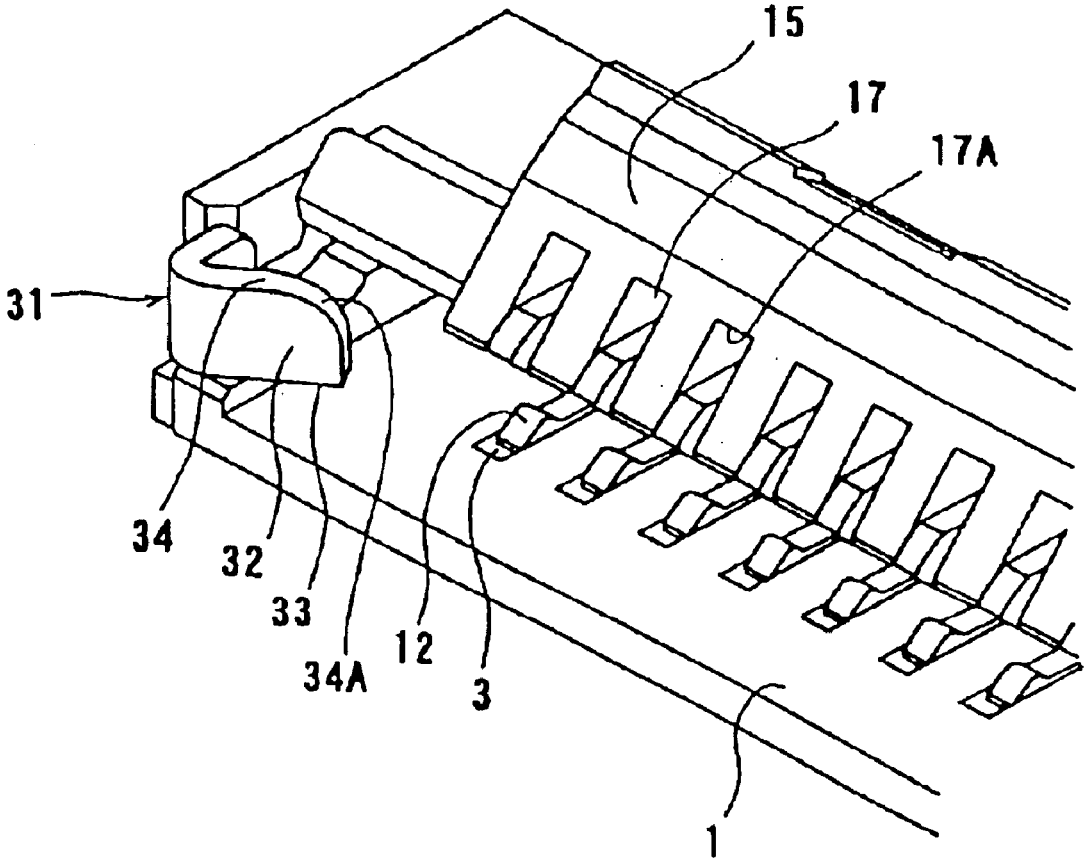
FIG. 3 is a perspective view of a main section of an electrical connector according to the third embodiment of the present invention.
Figure 4A:
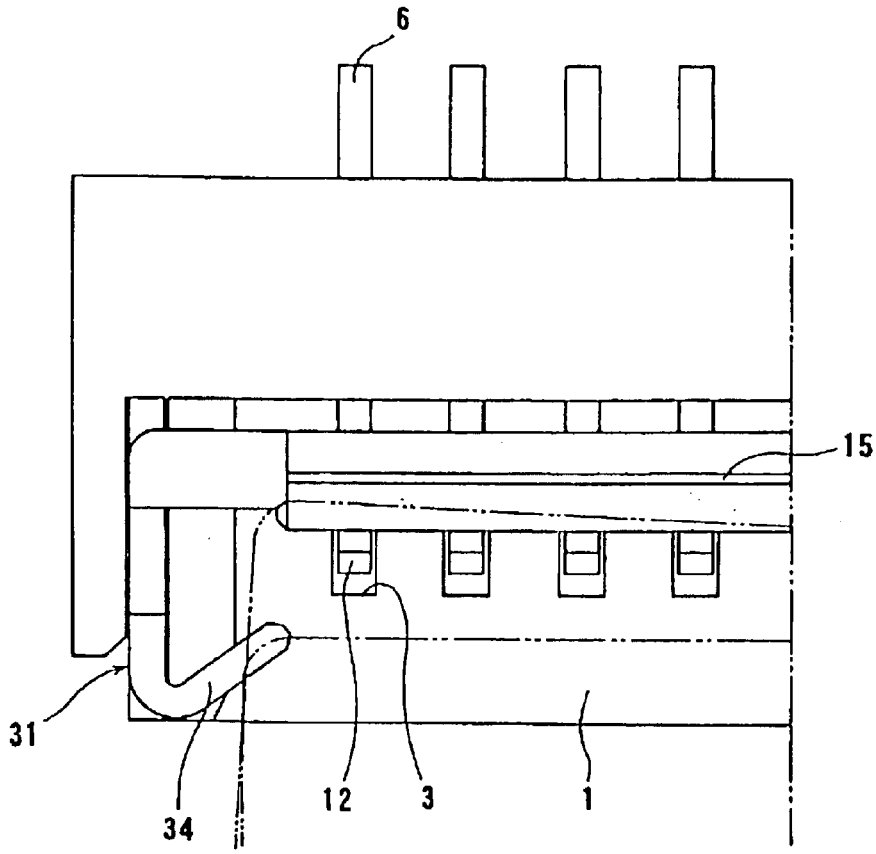
FIGS. 4(A) and (B) are a plan view and a front view of the electrical connector, respectively.
Figure 4B:
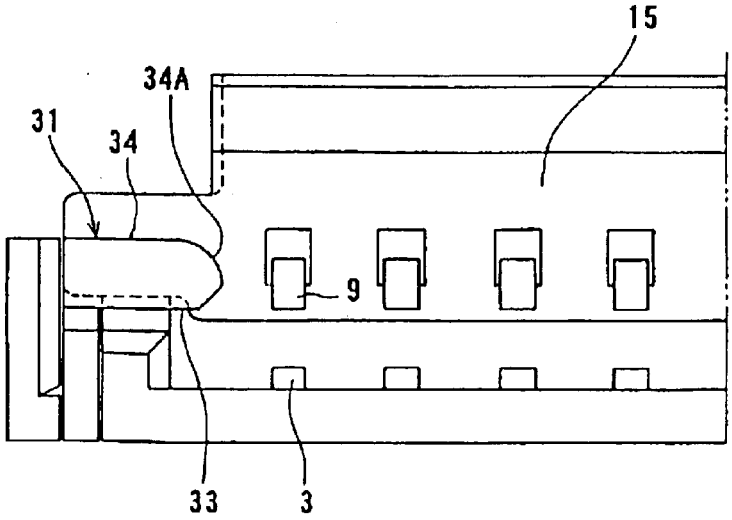
Figure 5:
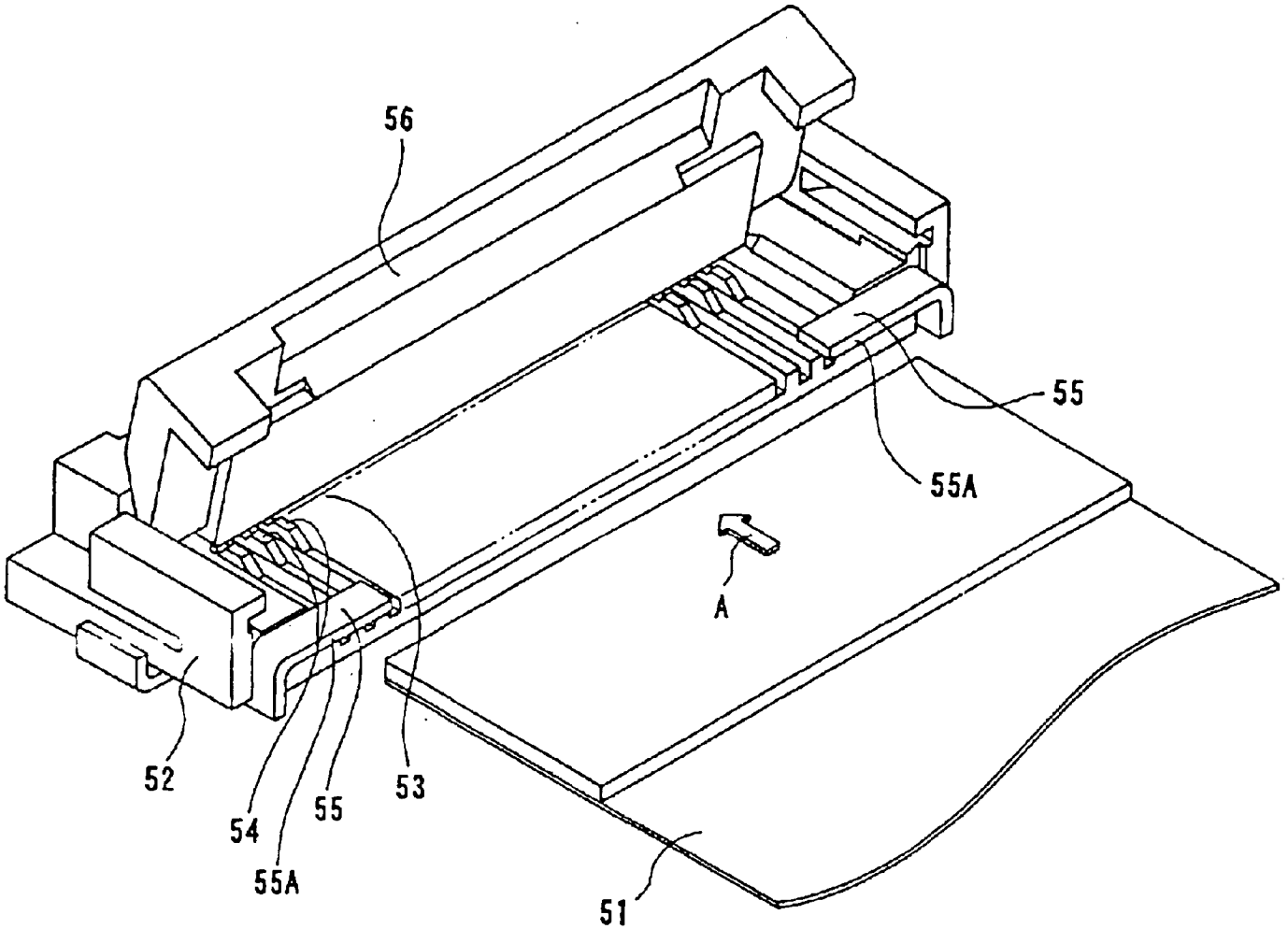
FIG. 5 is a perspective view of a conventional connector.

In the present embodiment as shown in FIGS. 3, 4(A) and 4(B), both sides of an open mouth 14 of a housing 1 have guides 31. Preferably, the guide 31 is made of a metal piece, has a surface which extends in the longitudinal direction, and has a slant section 32 which inclines to the inserting direction and cross direction of the flat cable. The lower edge 33 of this slant section 32 is positioned so as to longitudinally guide upper surface of the flat cable which is placed at the regular inserting position. The upper edge 34 has a curved section 34A which is rounded towards the tip.

In this embodiment, the slant surface 32 is bent from press-in section (arm 22), and the front edge of the open mouth 14 of housing 1 is exposed, so that the flat cable can be easily inserted at almost ideal regular position. Insertion proceeds smoothly, while upper surface is guided by lower edge 33 of the guide 31.

Where the front edge of a flat cable hits the guide (surface of the slant section 32) because front edge of the flat cable is slightly bent upward, or because inserting position is slipped upward, since the slant section 32 inclines inward, even if the flat cable is curved at the corner of the front edge, the flat cable can be inserted as is. At the inserting position where the flat cable separates from the guide, it slides into the regular position in the inserting space, returning to the flat condition by elasticity of itself.

Even if the front edge of the flat cable is positioned further upward and slides over the upper edge of the guide, the flat cable is guided downward by the slant of curved section 34A of the tip. In this case, the flat cable slides into the inserting space by its elasticity without damaging the guide by pushing the curved section of the flat cable lightly downward with finger. Also, the curved condition disappears.

The present invention is not limited to the above-described embodiments, and some variations are possible. First, in the first aspect of the invention, for the bearing of a pressure member, being different from the embodiment in FIG. 1, one can design the terminal to have a bearing section with convex curve, and then a pressure member to have a concave curve to engage with the convex curve. Here, "rotation" means rotation around the rotational center (the axis) and, also, includes a case that it accompanies a shift of the rotational axis in the vertical direction to this rotational axis.

Even if the engaging section between the pressure member and the terminal or the engaging piece is not formed by parallel surfaces (engaging surface extends in the rotational axis as in the examples of FIGS. 1 and 2) as in the illustrated figures, it can be formed by rectangular surface to the rotational axis. For an example, if the type in FIG. 1 is taken as an example, the groove 17 of the pressure member can be designed to be narrower as the pressure member rotates towards the open position so as to enable to push tightly the terminal at the inner surface of the groove at the open position. This tightly pushing force works as engaging force.

As described above, according to the present invention, the inserting space is opened without failure while the pressure member is maintained at the open position, or makes it easier to see, so that it ensures insertion of a flat cable towards entrance of the inserting space. Also, in the case of having a guide, even if the front edge of the flat cable hits the guide, the flat cable can be inserted as it is, or can slide into the inserting space simply by applying a little correcting force with a finger. Therefore, this invention improves workability of insertion to connect a flat cable with the connector.

What is claimed is:

1. An electrical connector for a flat cable, comprising:

a housing having an open mouth;

a plurality of terminals arranged and maintained in said housing, each terminal having a contact section at a position facing said open mouth of said housing and a bearing section at a position corresponding to and opposed to said contact section with respect to said flat cable; and a pressure member rotatable between an open position where said flat cable is inserted from said mouth into said housing and arranged on said contact sections and a closed position where said flat cable is pressed to said contact sections, said pressure member including a plurality of grooves for receiving ends of said terminals, a shaft provided through said grooves and supported by said bearing sections for rotation of said pressure member, and at least one pressure section provided between said grooves for pressing said flat cable to said contact sections;

said shaft being provided inside said grooves so that when said pressure member is rotated to said closed position, with said pressure section being pressed against said flat cable, said shaft is brought to such a position that it is not in contact with said flat cable.

2. The electrical connector according to claim 1, wherein said bearing section is provided above said shaft.

3. The electrical connector according to claim 2, wherein said bearing section has a concave shape facing downwardly to fit said shaft.

4. The electrical connector according to claim 1, wherein said shaft is provided through lower side of said grooves, said lower sides being opposite to bottoms of said grooves.

5. The electrical connector according to claim 4, wherein a lower portion of said shaft is cut off.

* * * * *